US007160631B2

(12) United States Patent
Nakajima et al.

(10) Patent No.: US 7,160,631 B2
(45) Date of Patent: Jan. 9, 2007

(54) ZINC-BASED COATED STEEL SHEET HAVING EXCELLENT ANTI-PEELING PROPERTY, FRICTIONAL PROPERTY, AND ANTI-GALLING PROPERTY AND METHOD OF MANUFACTURING THE SAME

(75) Inventors: Seiji Nakajima, Chiba (JP); Tomokatsu Katagiri, Chiba (JP); Yoichi Tobiyama, Chiba (JP); Chiaki Kato, Chiba (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/492,311

(22) PCT Filed: Oct. 23, 2002

(86) PCT No.: PCT/JP02/10987

§ 371 (c)(1),
(2), (4) Date: Apr. 12, 2004

(87) PCT Pub. No.: WO03/035931

PCT Pub. Date: May 1, 2003

(65) Prior Publication Data

US 2004/0241488 A1 Dec. 2, 2004

(30) Foreign Application Priority Data

Oct. 25, 2001 (JP) ..... 2001-328094
Oct. 25, 2001 (JP) ..... 2001-328095
Oct. 25, 2001 (JP) ..... 2001-328096

(51) Int. Cl.
*B32B 7/04* (2006.01)
*B32B 5/16* (2006.01)
*B32B 15/18* (2006.01)
*C23C 22/05* (2006.01)
*C23C 22/68* (2006.01)

(52) U.S. Cl. ..... 428/659; 428/621; 428/628; 428/323; 428/341; 427/672.2; 427/383.1; 508/172

(58) Field of Classification Search ..... 428/659, 428/621, 622, 624, 688, 908.8, 323, 341, 428/321; 427/430.1, 435, 383.7, 406; 508/162, 508/172

See application file for complete search history.

(56) References Cited

FOREIGN PATENT DOCUMENTS

JP 60-100684 A 6/1985
JP 60100684 A * 6/1985 ..... 427/383.7
JP 2003-201584 A * 7/2003

* cited by examiner

*Primary Examiner*—Jennifer C. McNeil
*Assistant Examiner*—Jason L. Savage
(74) *Attorney, Agent, or Firm*—DLA Piper US LLP

(57) ABSTRACT

The present invention provides for a zinc-based coated steel sheet having a zinc-based coating layer and a lubricant film, which is formed on the zinc-based coating layer, containing zinc phosphate particles in an amount of 50 wt. % or more, and having substantially no reaction layer formed by reaction between the zinc-based coating and the zinc phosphate particles, and a method for the manufacture thereof. The zinc-based coated steel sheet according to the present invention has an excellent anti-peeling property, excellent frictional property, even in the non-lubricated condition which occurs at areas where the press oil film is broken, and excellent anti-galling property.

9 Claims, 4 Drawing Sheets

ZINC-BASED COATED STEEL SHEET HAVING EXCELLENT ANTI-PEELING PROPERTY, FRICTIONAL PROPERTY, AND ANTI-GALLING PROPERTY AND METHOD OF MANUFACTURING THE SAME

TECHNICAL FIELD

The present invention relates to a zinc-based coated steel sheet having a dry film lubricant, which shows an excellent anti-peeling property, frictional property, particularly in the non-lubricated condition which exists where the press oil film is broken, and anti-galling property and a method for the manufacture thereof. The zinc-based coated steel sheet according to the present invention is suitable for use as an automotive steel sheet.

BACKGROUND ART

Zinc-based coated steel sheets, such as hot dip galvanized steel sheets and electrogalvanized steel sheets, have excellent corrosion resistance. However, these types of zinc-based coated steel sheets are inferior to cold-rolled steel sheets in press formability.

Up to the present, many methods of improving the press formability of zinc-based coated steel sheets have been proposed. For example, Unexamined Japanese Patent Publication No. 62-192597 discloses a method of applying an iron-based hard plating on the zinc coating layer. This method prevents galling between the coating layer and the die by increasing the hardness of the material surface. Unexamined Japanese Patent Publication No. 4-176878 discloses a method of improving the frictional property by forming a film containing an oxyate of P or B and a metallic oxide on the surface of the zinc coating layer. These conventional technologies, however, require construction of an additional exclusive-use treatment facility after the normal zinc coating line, which entails the problem of increased cost in manufacturing steel sheets.

Zinc-based coated steel sheets having a zinc phosphate film thereon are known as lubricant coated steel sheets having an excellent frictional property and good press formability. The method used to obtain the zinc phosphate film is called "prephosphate treatment," which is a method of forming a film by a dipping process, coating process, or the like using an acidic aqueous solution containing ions of zinc, phosphoric acid, nitric acid, fluoride, or the like. This method is applicable to general-purpose treatment facilities. However, in steel sheets having this type of zinc phosphate film, a reaction layer forms between the zinc coating layer and the zinc phosphate film. Since ploughing occurs in the reaction layer when the steel sheet is subjected to sliding, particularly during sliding under imperfect lubrication conditions, the frictional property is reduced and galling tends to occur. Consequently, this method has the problem of a poor frictional property in unlubricated local areas, for example, where the press oil film is broken during press forming. This type of zinc phosphate coating also has poor film removability (detachability) in the alkaline degreasing step, which is a preliminary treatment for painting processes, resulting in formation of a non-uniform phosphate film and degradation of appearance after painting.

Unexamined Japanese Patent Publication No. 9-111473 discloses a zinc-based coated steel sheet having excellent press formability, in which the zinc-based coated steel sheet has a coating composition which contains a compound having a "boundary lubrication function." The disclosure defines the term "boundary lubrication function" as "a function that the coating composition reacts with the lubricant oil or the surface of the steel sheet triggered by heat and pressure generated at the sliding interface in the press forming step, and bounds therewith, thus preventing the contact of the reaction product with the tool and the surface of the steel sheet." The disclosure mentions fine particle of phosphate as an example of a compound having the "boundary lubrication function." The embodiment of the disclosure describe a zinc phosphate film formed by applying and then drying an aqueous solution of zinc phosphate. However, it is the common understanding of persons skilled in the art that zinc phosphate has hard solubility in water, although it readily dissolves in dilute acid. Accordingly, the addition of an acid is essential to obtain an aqueous solution of zinc phosphate, as described in the embodiments. The zinc phosphate film which is obtained by applying and then drying the aqueous solution unavoidably forms a reaction layer between the zinc coating layer and the zinc phosphate film due to etching of the zinc coating layer by the acid component. That is, the technology of the disclosure is within the scope of known prephosphate treatments. Furthermore, since zinc phosphate is an inherently stable compound, the zinc phosphate has only weak performance in forming a reaction products with lubricant oil and with the metal of the steel sheet surface under the heat and pressure conditions which exist during press forming, and thus has substantially no boundary lubrication function.

Therefore, neither of the conventional technologies described above satisfactorily improves the press formability of zinc-based coated steel sheets. Since zinc-based coated steel sheets having a lubricative film are often used as, for example, steel sheets for automotive body panels, the film must also have an excellent anti-peeling property during surface cleaning treatments, such as blank cleaning for press forming.

It would therefore be advantageous to provide at low cost a zinc-based coated steel sheet having a dry film lubricant which has an excellent anti-peeling property in the blank cleaning step, as a preliminary treatment for press forming, and also has an excellent frictional property during press forming, particularly when some part of the material is in a non-lubricated condition, and an excellent anti-galling property, and to provide a method for the manufacture thereof.

It would also be advantageous to provide a zinc-based coated steel sheet having a lubricative film that has, in addition to the characteristics described in the first object, excellent film removability in the alkaline degreasing step, as a preliminary treatment for painting, and has excellent surface appearance after painting, and to provide a method for the manufacture thereof.

It would further be advantageous to provide a zinc-based coated steel sheet that does not deteriorate the film removability of the film in the alkaline degreasing step, and that has an excellent anti-peeling property in the blank cleaning step, and to provide a method for the manufacture thereof.

SUMMARY OF THE INVENTION

One aspect of the invention provides for a zinc-based coated steel sheet having a zinc-based coating layer and an additional film, formed on the zinc-based coating layer, containing zinc phosphate particles in an amount of 50 wt. % or more, and having substantially no reaction layer formed by reaction between the Zn coating layer and the zinc phosphate particles. The film of the zinc-based coated steel sheet preferably further contains an organic film-forming supplement.

In the two types of zinc-based coated steel sheets described above, the zinc phosphate particles preferably have a mean particle size of from 0.3 to 4.0 μm, and the zinc phosphate particles more preferably have a cumulative frequency distribution of 5% zinc phosphate particles having a particle size of 0.2 μm or more and 95% zinc phosphate particles having a particle size of 5.0 μm or less, counted from the smallest particles, respectively.

In the two types of zinc-based coated steel sheets described above, the zinc phosphate particles preferably have a mean particle size of from 0.3 to 4.0 μm, and the zinc phosphate particles more preferably have a cumulative frequency distribution of 5% zinc phosphate particles having a particle size of 0.2 μm or more and 95% zinc phosphate particles having a particle size of 5.0 μm or less, counted from the smallest particles, respectively.

In the types of zinc-based coated steel sheets described above, the zinc-based coating is preferably a galvannealed coating layer, and in particular, the galvannealed coating layer preferably has a rod-like crystal configuration comprising 50% or more of crystals at the surface thereof. Specifically, the crystal configuration of the surface of the galvannealed coating layer more preferably has a diffraction line profile, as determined by X-ray diffractometry, showing a ratio of $I/I_0$ of 0.25 or more, where I signifies the peak intensity at a lattice plane spacing d of 1.26 Å, $I_0$ signifies the peak intensity at a lattice plane spacing $d_0$ of 1.26 Å, and $I_0$ signifies the peak intensity at a lattice plane spacing $d_0$ of 1.28 Å.

Another aspect of the invention also provides for a method of manufacturing a zinc-based coated steel sheet having a film containing zinc phosphate particles in an amount of 50 wt. % or more, and has substantially no reaction layer formed by reaction between the zinc-based coating and the zinc phosphate particles, which method has the steps of: applying a zinc-based coating on the surface of the steel sheet; applying water containing zinc phosphate particles on the surface of the zinc-based coating layer; and drying the applied water containing zinc phosphate particles. As part of the method of manufacturing the zinc-based coated steel sheet, the water containing the zinc phosphate particles preferably further contains an organic film-forming supplement.

DETAILED DESCRIPTION

Figure 1:
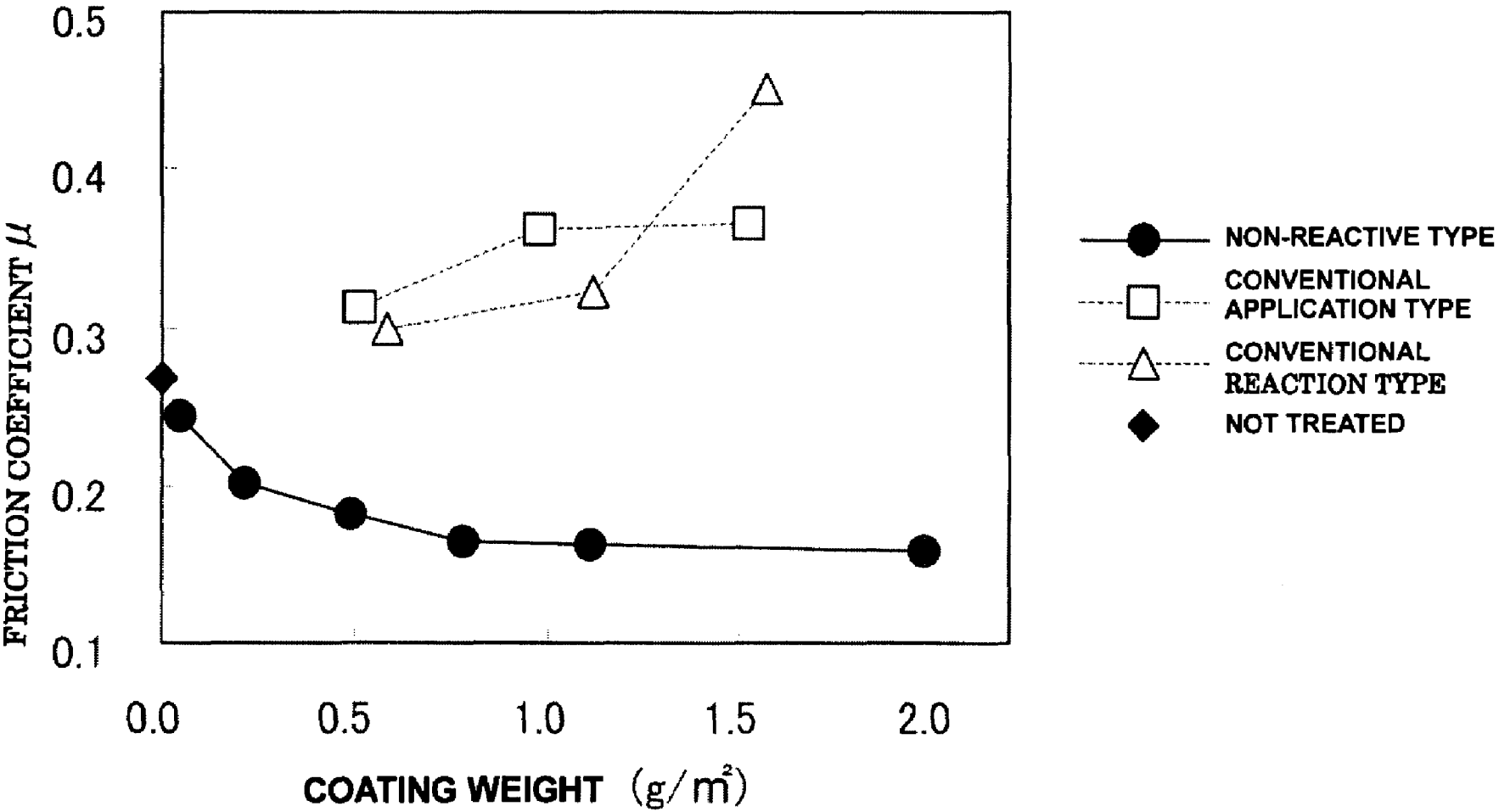
FIG. 1 is a graph showing the relationship between the coating weight of film and the friction coefficient for Example and Comparative Example, respectively.

Selected aspects of the invention are described in detail in the following.

The zinc-based coating layer is a coating layer containing zinc and is formed on the surface of a steel sheet, and the kind thereof is not specifically limited. That is, the zinc-based coating layer is an ordinary type of coating layer containing zinc, which can be manufactured by conventional processes by a person concerned, and the method of manufacture thereof may therefore be a known method. Examples of this kind of coating layer are a hot dip galvanized coating layer, a galvannealed coating layer, an electrogalvanized coating layer, a hot dip zinc-based coating layer containing one or more of Al, Mg, Si, and the like, and an electrogalvanized zinc-based coating layer containing one or more of Ni, Fe, Co, and the like.

It is known that press forming of a zinc-based coated steel sheet tends to cause adhesion between the sheet and the die due to the inherent soft property of zinc, and may induce die galling, depending on conditions, due to high sliding resistance. Although formability is generally improved to a certain degree by using press oil, local breaks in the oil film tend to occur when forming large components and components having low formability, and this discontinuity of the oil film can result in press cracking.

Since dry film lubricant such as prephosphate film are effective in preventing the kind of increase in local sliding resistance caused by breaks in the oil film, as described above, they can be expected to improve formability when used in combination with an appropriate press oil.

However, even steel sheets with a prephosphate film show a degraded frictional property in some cases due to galling resulting from increased sliding resistance during sliding under absence of oil. The term "galling" referred to herein means scoring damage on the surface of the material to be formed (base material) in the press forming step, accompanied by seizing (adhesion) of the material to be formed with the die, which occurs at the area of sliding between the die and the material to be formed.

Up to the present, we investigated sliding behavior under the absence of oil with zinc-based coated steel sheets having a prephosphate film, and found that the mechanism of degradation of the frictional property and the occurrence of galling is ploughing of the reaction layer formed between the zinc-based coating layer and the zinc phosphate film.

In the conventional prephosphate treatment, the prephosphate film is formed by mixing a soluble zinc compound, a reaction accelerator, and the like in an acidic solution consisting mainly of phosphoric acid, which serves to dissolve a portion of the surface of the underlying zinc-based coating layer. Accordingly, a reaction layer inevitably exists at the interface between the formed film and the zinc-based coating layer. Although the configuration of the reaction layer has not been fully analyzed, X-ray diffractometry often identifies the presence of Hopeite (zinc phosphate tetrahydrate). In addition, films formed by the dipping process frequently show scaly zinc phosphate crystals 5 to 10 μm in size.

This type of crystalline reaction layer shows growth of crystals from the underlying zinc-based coating layer. Therefore, it is presumed that the vertical load and shearing stress in the horizontal direction which occur during sliding induce breaks and separation of the reaction layer together with the underlying zinc-based coating layer, or induce breaks in the crystal grains, separating the reaction layer, and further induce die galling at the gap between the die and the base material, and ultimately causing material defects and other damage.

By applying a dry film lubricant consisting mainly of zinc phosphate, we expected improvement of the frictional property under absence of oil and further, improvement of the anti-galling property by preventing the formation of a reaction layer between the zinc phosphate film and the surface of the zinc-based coating layer.

That is, we adopted zinc phosphate particles as the main component of the film in forming the zinc phosphate film, and used a treatment solution that contains no component such as phosphoric acid which chemically reacts with the zinc-based coating layer. Specifically, water which contains zinc phosphate particles and an organic film-forming supplement (this solution may also be referred to hereinafter as the aqueous treatment solution) was adopted as the treatment solution to form this type of dry film lubricant.

Thus, we have provided a method of manufacturing a zinc-based coated steel sheet with a zinc phosphate-film, having the steps of: applying a zinc-based coating to the surface of a steel sheet; applying water containing zinc phosphate particles to the surface of the zinc-based coating layer; and drying the applied water containing zinc phosphate particles, resulting in an excellent anti-peeling property, frictional property, frictional property under absence of oil, and anti-galling property. By this method, a dry film lubricant consisting mainly of zinc phosphate particles is successfully formed on the surface of the zinc-based coating layer without forming a reaction layer by reaction with the uppermost portion of the zinc-based coating layer.

However, we do not completely exclude the formation of a slight amount of reaction layer, the effect being obtainable if the formed amount of the reaction layer is 0.1 $g/m^2$ or less. Accordingly, the expression "substantially no reaction layer is formed" signifies that the formed amount of the reaction layer is 0.1 $g/m^2$ or less.

Thus, another aspect of the invention also provides for a zinc-based coated steel sheet which has a film, formed on a Zn-based coating layer, containing zinc phosphate particles in an amount of 50 wt. % or more, and having substantially no reaction layer formed by reaction between the zinc-based coating and the zinc phosphate particles.

Accordingly, the coating weight of the dry film lubricant obtained by applying the aqueous treatment solution and by drying thereof is preferably in a range of approximately from 0.05 to 2.0 $g/m^2$. The coating weight of 0.05 $g/m^2$ or more sufficiently improves the frictional property, whereas improvement in the frictional property reaches saturation at coating weights above 2.0 $g/m^2$, which are also disadvantageous in terms of cost. Thus, the particularly preferred range of the coating weight of the film is from 0.2 to 2.0 $g/m^2$.

Many types of zinc phosphate particles exist, including zinc phosphate tetrahydrate particles, zinc phosphate dehydrate particles, zinc phosphate anhydride particles, and the like. Although any of these zinc phosphate particles may be used in the present invention, zinc phosphate tetrahydrate particles are most preferable because they keep a consistent structure in the ambient temperature range of not more than 100° C., and are the most stable among the various existing types. The weight of the zinc phosphate particles according to the present invention signifies the weight of zinc phosphate counting out that of the hydrate therefrom.

The zinc phosphate film is normally obtained by applying an adequate amount of treatment solution, followed by drying at temperatures of approximately from 60° C. to 120° C.

However, since this aspect of the invention does not use an acid such as phosphoric acid in the aqueous treatment solution, there was concern regarding degradation of film adhesion and peeling of the film in the blank cleaning step, as a preliminary treatment for press forming. This concern is resolved by adding an adequate amount of an organic film-forming supplement to the treatment solution.

That is, the zinc-based coated steel sheet preferably further contains an organic film-forming supplement in the coating. The aqueous treatment solution, which contains zinc phosphate particles and an organic film-forming supplement preliminary prepared by the reaction, is preferably applied on the surface of a zinc-based coating layer using, for example, a roll coater, and is then dried to form the film. Adequate conditions described above, such as the coating weight of zinc phosphate and the film-forming condition, may be used as it is.

This type of aqueous treatment solution does not contain components such as phosphoric acid which chemically react with zinc-based coating layers. Accordingly, no reaction layer is formed at the interface between the zinc phosphate film and the zinc-based coating layer, thus no ploughing occurs when stress is applied, and no degradation of the frictional property occurs. In addition, since the film contain an organic film-forming supplement, no peeling of the film occurs in the blank cleaning step.

As described above, the simple zinc phosphate particles are capable of forming a film. However, the use of an organic film-forming supplement is advantageous in controlling the anti-peeling property and improving film removability, and further, in handling of the film. That is, from the latter point of view, the organic film-forming supplement also functions as a binder for the zinc phosphate particles.

When using the organic film-forming supplement, the content of the organic film-forming supplement in the film is preferably 50 wt. % or less. Improvement in the anti-peeling property reaches saturation when the content of the organic film-forming supplement in the coating exceeds 50 wt. %, and the cost increases. A more preferable range of the content of the organic film-forming supplement in the film is from 1 to 50 wt. %, and the most preferable range thereof is from 3 to 35 wt. %.

Suitable organic film-forming supplements include water-soluble polymers such as methyl cellulose, carboxymethyl cellulose, hydroxyethyl cellulose, polyvinyl alcohol, polyethylene glycol, xanthan gum, and gua gum, derivatives thereof, and salts thereof. Among these, water-soluble polymer is preferred as a binder. Furthermore, as needed, a surfactant or the like may be added as a dispersion stabilizer for the zinc phosphate particles.

Considering application to automobile manufacturing processes, which usually use steel sheets with rust-preventive oil and cleaning oil applied, it is also important for the film-forming supplement described above to be stable in the presence of rust-preventive oils and cleaning oils.

The particle size of the zinc phosphate particles described above is not specifically limited. However, the mean particle size thereof is preferably in a range of from 0.3 to 4.0 μm for the reason mentioned below.

The mean particle size can be determined by a commercially available particle size distribution analyzer. An example of an applicable particle size distribution analyzer is the laser diffraction-scattering particle size distribution analyzer. This type of analyzer determines the cumulative frequency distribution of the particle size, and the mean particle size is defined as the particle size at 50% of the frequency distribution, counted from the finest particles.

We conducted an extensive investigation, including a large number of experiments, on the relationship between the particle size distribution of zinc phosphate particles, film removability in the alkaline degreasing step, and phosphatability and paintability in the succeeding steps, and found that the use of zinc phosphate particles having mean particle sizes of from 0.3 to 4.0 μm effectively improves film removability in the alkaline degreasing step and phosphatability and paintability in the succeeding steps, thus completing the desired improvements.

Figure 2:
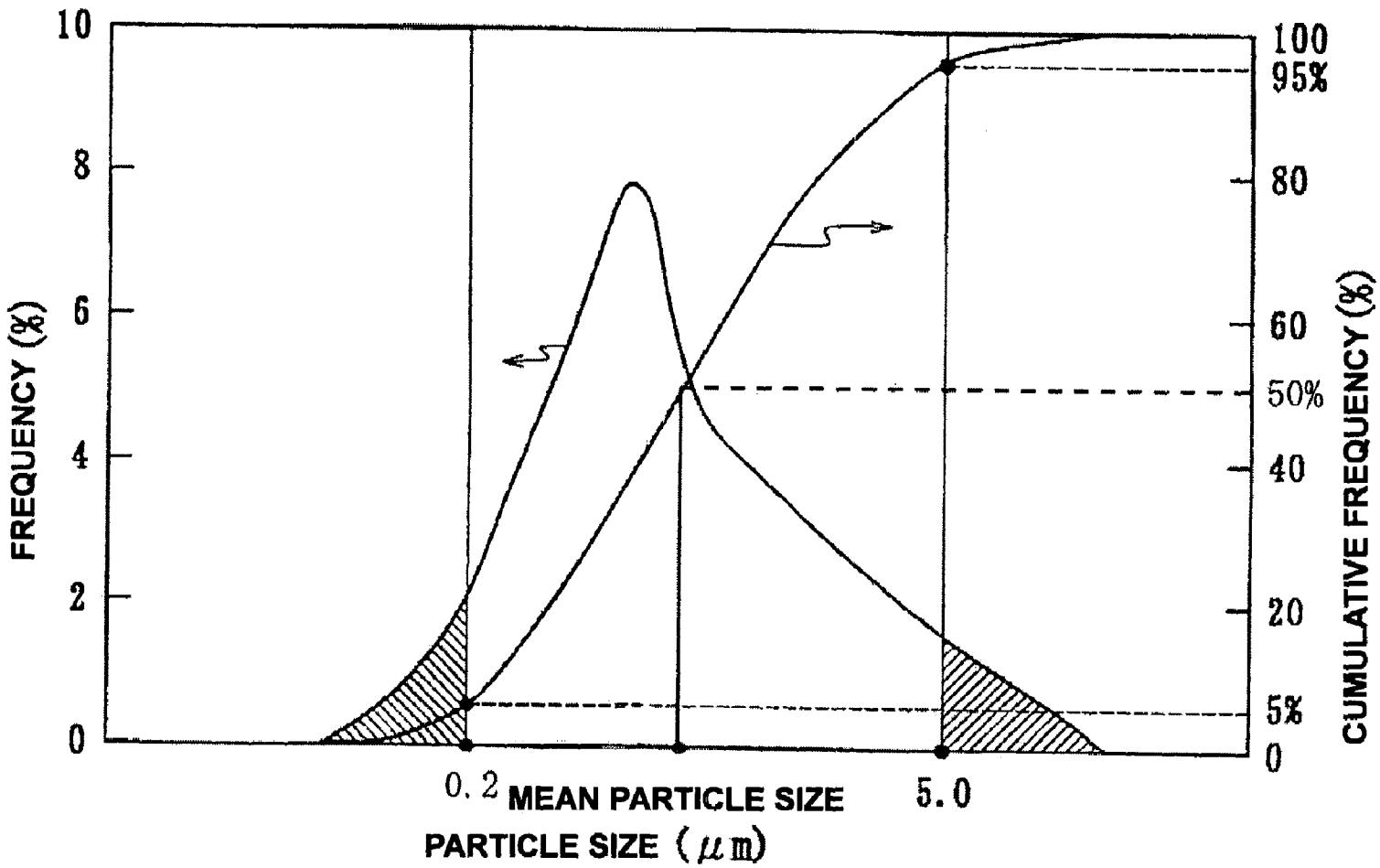
FIG. 2 is a graph showing the relationship between the size, frequency, and cumulative frequency of zinc phosphate particles.

Furthermore, it was found that, after satisfying the range of the mean particle size mentioned above, more effective results can be obtained by use of fine particles of zinc phosphate with a cumulative frequency distribution of 5% in the particle size range of 0.2 μm and 95% in the particle size range of 5.0 μm or less, counted from the smallest particles, respectively as shown in FIG. 2.

The reason for specifying a cumulative frequency distribution of 5% for the particle size of 0.2 μm or more, counted from the smallest particles, is to reduce the quantity of fine particles and thereby reduce degradation of film removability in the alkaline degreasing step, which is caused by entrapment of fine particles in concavities on the zinc-based coating layer. On the other hand, the reason for specifying a cumulative frequency distribution of 95% for the particle size of 5.0 μm or less, counted from the smallest particles, is to reduce the quantity of coarse particles and thereby improve the anti-peeling property in the blank cleaning step.

However, a non-reactive type dry film lubricant with improved film removability in the alkaline degreasing step shows decreased adhesive strength with the zinc-based coating layer. Therefore, if this type of film is applied to automotive steel sheets, part of the film may peel off in the blank cleaning step before press forming, and as a result, the steel sheet may fail to provide a satisfactory frictional property in the pressing step.

To solve this problem, we conducted a study on the second improvement aspect, and found that it can be solved by use of a galvannealed coating, which is typically characterized by large surface irregularity, as the zinc-based coating, and adoption of a crystal configuration in the uppermost surface of the zinc-based coating layer consisting mainly of rod-like crystals.

That is, to improve the anti-peeling property of film in the blank cleaning step, we focused on the crystal configuration at the surface of the galvannealed coating layer, as the underlayer of the zinc phosphate film, and conducted an investigation on its relationship with the anti-peeling property. This investigation showed that, by adopting a crystal configuration consisting mainly of rod-like crystals on the surface of the underlying zinc-based coating layer, the anti-peeling property in the blank cleaning step can be improved without degrading film removability in the prepainting treatment stage.

Figure 3:
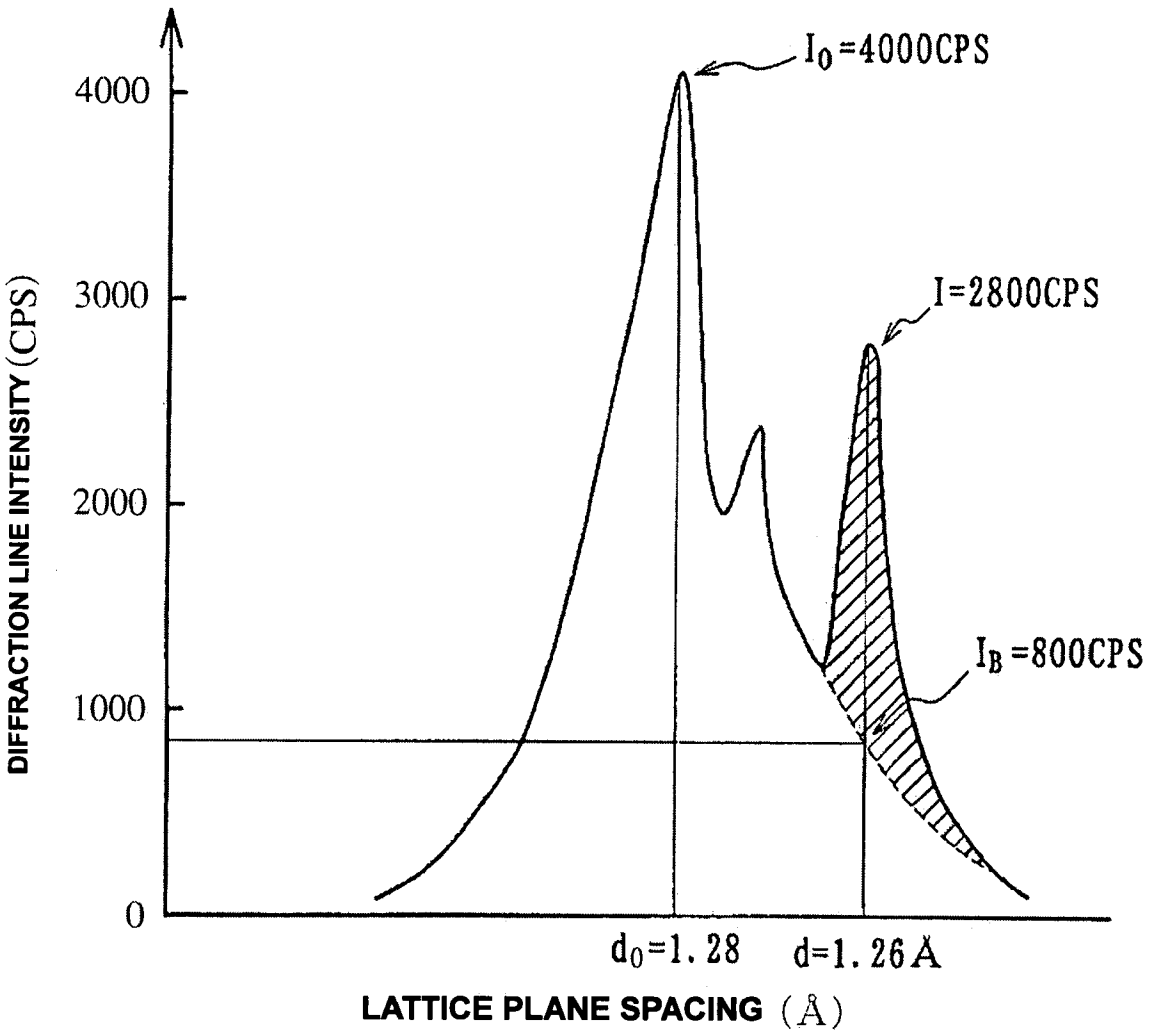
FIG. 3 is a schematic drawing of the X-ray diffraction profiles of a galvannealed layer.

Furthermore, we conducted an investigation to determine the particularly preferable configuration of the crystals in the uppermost surface of this type of galvannealed coating layer, and found that the particularly preferred crystal configuration is one which satisfies a diffraction line profile determined by X-ray diffractometry, as shown in FIG. 3, of 0.25 or more for the ratio $I/I_0$, where I signifies the peak intensity at a lattice plane spacing d of 1.26 Å (corresponding to rod-like crystals), and $I_0$ signifies the peak intensity at a lattice plane spacing $d_0$ of 1.28 Å (corresponding to granular crystals).

The galvannealed coating layer which is generally used in automotive steel sheets is generally known to comprise four crystal phases: namely, Γ phase ($Fe_3Zn_{10}$), $\Gamma_1$ phase ($Fe_5Zn_{21}$), $\delta_1$ phase ($FeZn_7$), and ζ phase ($FeZn_{13}$). These Fe—Zn alloy crystals grow from the interface between the zinc coating and the substrate steel sheet toward the coating surface in the order $\Gamma \rightarrow \Gamma_1 \rightarrow \delta_1 \rightarrow \zeta$, by diffusion of Fe from the substrate steel sheet. In addition, the relative contents of the individual crystal phases of these Fe—Zn alloy crystals also vary, depending on the composition of the zinc coating bath and the alloying conditions in the manufacturing process. The crystal phases comprising the uppermost layer of the coating are the ζ phase and $\delta_1$ phase. However, the configuration of the zinc coating surface observed by SEM or the like differs significantly with differences in the percentage of the individual crystal phases in the surface layer.

That is, when the percentage of $\delta_1$ phase is large, the surface configuration consists predominantly of granular crystals. On the other hand, if the percentage of ζ phase is large, the surface configuration consists predominantly of rod-like crystals. When these surface configurations are analyzed by respective X-ray diffraction patterns, they show a correlation with the intensity ratio of the peak in the vicinity of the lattice plane spacing $d_0$=1.28 Å, (peak intensity $I_0$), belonging to the $\delta_1$ phase, to the peak in the vicinity of lattice plane spacing d=1.26 Å, (peak intensity I), belonging to the ζ phase. Under the condition of $I/I_0 \geqq 0.25$, the surface configuration consists mainly of rod-like crystals, and under the condition of $I/I_0 < 0.25$, the surface configuration consists mainly of granular crystal.

Particularly favorable results are attained by a crystal configuration consisting mainly of rod-like crystals, which shows a diffraction line profile, as determined by the X-ray diffractometry, of 0.25 or more for the ratio $I/I_0$, where I signifies the peak intensity at a lattice plane spacing d of 1.26 Å, and $I_0$ signifies the peak intensity at a lattice plane spacing $d_0$ of 1.28 Å.

EXAMPLES

For further understanding, examples are given below, in which selected aspects of the invention are described in greater detail. However, the invention is not limited to these examples.

Example A

Four kinds of zinc-based coated steel sheets, as shown in Table 1, were used as the base steel sheets. The zinc phosphate film according to the present invention was formed on each of these zinc-based coated steel sheets under the conditions given below.

As shown in Table 2, respective aqueous treatment solutions containing 10 to 20 wt. % of zinc phosphate particles having mean particle sizes of from 0.6 to 2.9 μm and 0 to 10 wt. % of respective organic film-forming supplements were applied to the respective zinc-based coated steel sheets. The applied solution was dried at 8° C. The organic film-forming supplements were carboxymethyl cellulose (degree of polymerization: 700), polyvinyl alcohol (average molecular weight: 1000), polyethylene glycol (average molecular weight: 1000), and hydroxyethyl cellulose (degree of polymerization: 700), respectively.

Comparative Example

Zinc-based coated steel sheets prepared by the conventional reaction type or application type zinc phosphate treatment were used as comparison materials. These respective treatments are described below.

[Reaction Type]

After surface conditioning (PREPALENE Z, manufactured by Nihon Parkerizing Co., Ltd.), each of the zinc-based coated steel sheets was dipped in a zinc phosphate treatment solution ($PO_4^{3-}$:10 to 20 g/l, $Zn^{2+}$:0.6 to 2.0 g/l, $Ni^{2+}$:0.5 to 2.0 g/l, $Mn^{2+}$:0.1 to 1.0 g/l, $NO_3^-$:1.0 to 3.0 g/l, $NO_2^-$:0.1 to 1.0 g/l, and $F^+$:O.1 to 1.0 g/l) and washed with water, then dried.

[Application Type]

A zinc phosphate treatment solution ($PO_4^{3-}$:5 to 30 g/l, $Zn^{2+}$:0.6 to 2.0 g/l, $Ni^{2+}$,:0.1 to 1.0 g/l, $Mn^{2+}$:0.1 to 1.0 g/l, $NO_3^-$:1.0 to 2.0 g/l, $NO_2^-$:0.1 to 0.5 g/l, and $F^+$:0.1 to 0.5 g/l) was applied to each of the zinc-based coated steel sheets, then dried.

The coating weight was measured by the peeling method as follows. A specimen on which the film was formed was dipped in an aqueous solution, which had been prepared by adding water to a mixture of 20 g of ammonium bichromate and 480 g of concentrated ammonia aqueous solution to make up 1 liter, at 20° C. for 15 minutes. The mass loss of the specimen was determined by weighing the specimen before and after dipping. The coating weight was calculated by dividing the mass loss by the surface area of the specimen.

The coating weight was determined by the gravimetric method by the procedure described below. The respective weights of the specimen before and after zinc phosphate film were measured to obtain the weight increase. The obtained weight increase was divided by the surface area of the specimen to obtain the film weight. In specimens which formed a reaction layer, the amount of the formed reaction layer was calculated based on the fact that the coating weight determined by the peeling method becomes larger than that determined by the gravimetric method. Thus, the amount of formed reaction layer was calculated by the equation: Amount of reaction layer=(Coating weight by peeling method)−(Coating weight by gravimetric method)

The term "coating weight" referred to herein means the coating weight determined by the peeling method unless otherwise noted.

The anti-peeling property was evaluated by the procedure given below. A cleaning oil (P16OO, manufactured by Nisseki Mitsubishi Oil Corporation) was applied to the specimen. The surface of the applied cleaning oil was rubbed with a polypropylene brush 20 repeated strokes. The surface of the specimen was then degreased with petroleum benzin. The difference in the coating weight before and after treatment was determined to evaluate the anti-peeling property. Increased peeling in this test indicates an increased possibility of poor frictional property in press forming.

The frictional property was evaluated by the friction coefficient (μ) determined by a friction test (applied pressure: 10 MPa, sliding distance: 100 mm, sliding speed: 10 mm/s) under absence of oil. Galling in the friction test was evaluated visually.

Using zinc-based coated steel sheets prepared in the above manner, the coating weight, amount of formed reaction layer, anti-peeling property, fricitional property, and occurrence of galling were determined. The results are given in Table 2-1 and Table 2-2.

As seen in these tables, the zinc-based coated steel sheets with a dry film lubricant according to the present invention did not form a significant reaction layer between the dry film lubricant and the zinc-based coating layer, and showed an excellent anti-peeling property, frictional property, and anti-galling property.

FIG. 1 shows the relationship between the coating weight and the friction coefficient with various film-forming methods. As shown in FIG. 1, the present invention provides an excellent frictional property, even under the condition of absence of oil, independent of the coating weight.

Example B

Galvannealed steel sheets were used as the base steel sheets. Aqueous treatment solutions containing 5 wt. % of carboxymethyl cellulose (degree of polymerization: 700) and 15 wt % of zinc phosphate particles with various mean particle sizes and accumulated frequency distributions were prepared to have the respective compositions in Table 3. Each of the aqueous treatment solutions prepared in this manner was applied to the respective galvannealed steel sheets. The applied aqueous treatment solution was then dried at 80° C. to form a film having a coating weight of 0.60 $g/m^2$ Film removability in the alkaline decreasing step was evaluated as follows. The alkaline degreasing solution (FC4460, manufactured by Nihon Parkerizing Co., Ltd.) used in preliminary treatment for phosphating was adjusted to a standard condition concentration (20 g/l of FC4460A and 12 g/l of FC4460B), then adjusted to pH 10 by adding dry ice. The zinc phosphate coated galvannealed steel sheets were dipped in the alkaline degreasing solution prepared in this manner for 60 seconds at 40° C., and were washed with water, followed by drying. Next, the coating weight after degreasing was measured. The alkaline film removal rate was calculated from the ratio of the measured coating weight after alkaline degreasing to the coating weight before degreasing. A lower film removal rate, as determined by this test, indicates a higher likelihood of irregular phosphating and poor appearance in the succeeding painting process.

The anti-peeling property was evaluated by the same method as in Example A.

The alkaline film removability and anti-peeling property of the zinc-based coated steel sheets thus obtained are given in Table 3. The evaluations of alkaline film removability and the anti-peeling property were based on the criteria described below.

Alkaline Film-removability

◎ (excellent): 90%≦Film-removal rate

○ (good): 80%≦Film-removal rate<90%

Δ (fair): Film-removal rate<80%

Anti-peeling Property

◎ (excellent): Peeling rate≦10%

○ (good): 10%<Peeling rate≦20%

Δ (fair): 20%<Peeling rate

As shown in Table 3, use of fine zinc phosphate particles having an appropriate particle size distribution according to the present invention provides high film removability in the alkaline degreasing step and a strong anti-peeling property in the blank cleaning step.

Example C

A zinc coating was applied to the surface of ordinary steel sheets 0.8 mm in thickness by hot dip galvanizing (coating bath composition; Fe:8 to 14 wt. %, Al:0.1 to 0.2 wt. %, and the balance of zinc). The coated steel sheets were then subjected to alloying treatment to prepare galvannealed steel sheets. The entry temperature of the steel sheet at the bath, bath temperature, and alloying temperature were varied with the respective steel sheets to produce galvannealed steel sheets having varied crystal configurations and phase structures in the coating layer, as shown in Table 4. Each of the galvannealed steel sheets prepared in this manner was used as a base material. An aqueous treatment solution containing 15 wt. % of zinc phosphate particles having a mean particle size of 1.0 μm and 5 wt. % of carboxymethyl cellulose (degree of polymerization: 700) was applied to the galvannealed steel sheets, followed by drying at 80° C. to obtain a zinc phosphate film with a coating weight of 0.60 g/m$^2$.

The anti-peeling property of the galvannealed steel sheets obtained in this manner is shown in Table 4. The anti-peeling property was evaluated based on the criteria described below.

⊚ (excellent): Peeling rate≦10%

○ (good): 10%<Peeling rate≦20%

Δ (fair): 20%<Peeling rate

The crystal structure of the galvannealed coating layer was analyzed by X-ray diffractometry (Cu tube bulb). The configuration of the coating surface was observed by a scanning electron microscope (SEM).

The anti-peeling property was evaluated by the same method as in Example A.

Table 4 shows that the galvannealed steel sheets with a dry film lubricant according to the present invention provide an excellent anti-peeling property.

Figure 4:
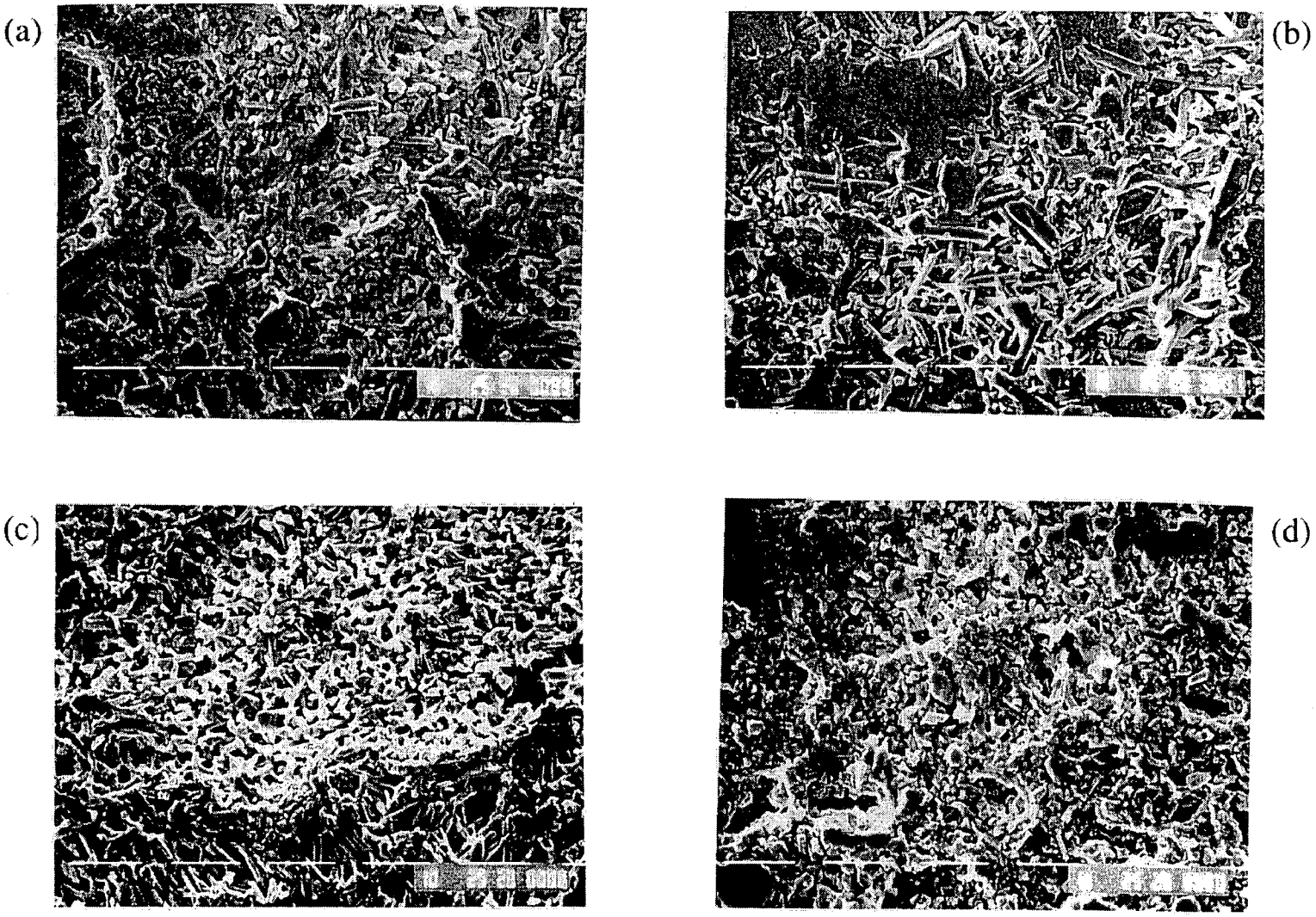
FIG. 4 shows scanning electron microscope (SEM) images of the crystal configurations of the uppermost surface of several galvannealed layers.

FIG. 4(*a*)–(*d*) shows the observed SEM images of the crystal configuration at the uppermost surface of the galvannealed coating layer. The images in FIG. 4(*a*) through (*c*) show a galvannealed coating crystal structure of predominantly rod-like crystals, while the image in FIG. 4(*d*) shows predominantly granular crystals in the coating.

TABLE 1

| Symbol | Type | Coating weight, other |
|---|---|---|
| GA | Galvannealed steel sheet | Both-side coating; 50 g/m$^2$/side |
| GI | Hot dip galvanized steel sheet | Both-side coating; 50 g/m$^2$/side |
| GL | Hot dip zinc-aluminum coated steel sheet (GALVALUME) | Both-side coatng; 50 g/m$^2$/side; Al: 55 mass % |
| EG | Electrogalvanized steel sheet | Both-side coating; 50 g/m$^2$/side |

TABLE 2-1

| | | | Aqueous treatment solution | | | |
|---|---|---|---|---|---|---|
| | | | Zinc phosphate particles | | Organic film-forming supplement | |
| | Type | Base steel sheet | Mean particle size (μm) | Content (wt. %) | Type | Content (wt. %) |
| Example | | | | | | |
| 1 | Non-reactive type | GA | 1.0 | 15 | Carboxymethyl cellulose (degree of polymerization: 700) | 5 |
| 2 | Non-reactive type | GA | 1.0 | 15 | Carboxymethyl cellulose (degree of polymerization: 700) | 5 |
| 3 | Non-reactive type | GA | 1.0 | 15 | Carboxymethyl cellulose (degree of polymerization: 700) | 5 |
| 4 | Non-reactive type | GI | 1.0 | 15 | Carboxymethyl cellulose (degree of polymerization: 700) | 5 |
| 5 | Non-reactive type | GL | 1.0 | 15 | Carboxymethyl cellulose (degree of polymerization: 700) | 5 |
| 6 | Non-reactive type | EG | 1.0 | 15 | Carboxymethyl cellulose (degree of polymerization: 700) | 5 |
| 7 | Non-reactive type | GA | 0.6 | 15 | Carboxymethyl cellulose (degree of polymerization: 700) | 5 |
| 8 | Non-reactive type | GA | 2.9 | 15 | Carboxymethyl cellulose (degree of polymerization: 700) | 5 |
| 9 | Non-reactive type | GA | 1.0 | 10 | Carboxymethyl cellulose (degree of polymerization: 700) | 10 |
| 10 | Non-reactive type | GA | 1.0 | 20 | — | 0 |
| 11 | Non-reactive type | GA | 1.0 | 15 | Polyvinyl alcohol (average molecular weight: 1000) | 5 |
| 12 | Non-reactive type | GA | 1.0 | 15 | Polyethylene glycol (average molecular weight: 1000) | 5 |
| 13 | Non-reactive type | GA | 1.0 | 15 | Hydroxyethyl cellulose (degree of polymerization: 700) | 5 |
| 14 | Non-reactive type | GA | 1.0 | 15 | Carboxymethyl cellulose (degree of polymerization: 700) | 5 |
| 15 | Non-reactive type | GA | 1.0 | 15 | Carboxymethyl cellulose (degree of polymerization: 700) | 5 |
| 16 | Non-reactive type | GA | 1.0 | 15 | Carboxymethyl cellulose (degree of polymerization: 700) | 5 |
| Comparative Example | | | | | | |
| 1 | Not treated | GA | Not treated | | | |
| 2 | Conventional application type | GA | Applying application type treatment solution, followed by drying. | | | |
| 3 | Conventional application type | GA | Applying application type treatment solution, followed by drying. | | | |

TABLE 2-1-continued

| | | | Aqueous treatment solution | | | |
|---|---|---|---|---|---|---|
| | | | Zinc phosphate particles | | Organic film-forming supplement | |
| | Type | Base steel sheet | Mean particle size (μm) | Content (wt. %) | Type | Content (wt. %) |
| 4 | Conventional application type | GA | Applying application type treatment solution, followed by drying. | | | |
| 5 | Conventional reaction type | GA | Dipping in reaction type treatment solution, followed by washing with water and drying. | | | |
| 6 | Conventional reaction type | GA | Dipping in reaction type treatment solution, followed by washing with water and drying. | | | |
| 7 | Conventional reaction type | GA | Dipping in reaction type treatment solution, followed by washing with water and drying. | | | |

TABLE 2-2

| | Film | | | | | | Performance | | |
|---|---|---|---|---|---|---|---|---|---|
| | Zinc phosphate particles | | Organic film-forming supplement | Coating weight | | Amount of formed reaction layer ($g/m^2$) | Anti-peeling property | Frictional property | Anti-galling property |
| | Mean particle size (μm) | Content (wt. %) | Content (wt. %) | Peeling method ($g/m^2$) | Gravimetric method ($g/m^2$) | | Peeling rate (%) | Friction coeffi-cient (μ) | Occurrence of galling* |
| Example | | | | | | | | | |
| 1 | 1.0 | 75 | 25 | 0.05 | 0.05 | ≦0.01 | 12 | 0.244 | None |
| 2 | 1.0 | 75 | 25 | 0.21 | 0.20 | ≦0.01 | 15 | 0.201 | None |
| 3 | 1.0 | 75 | 25 | 0.49 | 0.50 | ≦0.01 | 13 | 0.182 | None |
| 4 | 1.0 | 75 | 25 | 0.60 | 0.59 | ≦0.01 | 16 | 0.178 | None |
| 5 | 1.0 | 75 | 25 | 0.58 | 0.58 | ≦0.01 | 15 | 0.180 | None |
| 6 | 1.0 | 75 | 25 | 0.61 | 0.60 | ≦0.01 | 13 | 0.175 | None |
| 7 | 0.6 | 75 | 25 | 0.60 | 0.60 | ≦0.01 | 4 | 0.171 | None |
| 8 | 2.9 | 75 | 25 | 0.60 | 0.60 | ≦0.01 | 17 | 0.171 | None |
| 9 | 1.0 | 50 | 50 | 0.60 | 0.60 | ≦0.01 | 3 | 0.182 | None |
| 10 | 1.0 | 100 | 0 | 0.60 | 0.60 | ≦0.01 | 15 | 0.164 | None |
| 11 | 1.0 | 75 | 25 | 0.60 | 0.60 | ≦0.01 | 13 | 0.178 | None |
| 12 | 1.0 | 75 | 25 | 0.60 | 0.60 | ≦0.01 | 13 | 0.178 | None |
| 13 | 1.0 | 75 | 25 | 0.60 | 0.60 | ≦0.01 | 13 | 0.178 | None |
| 14 | 1.0 | 75 | 25 | 0.78 | 0.79 | ≦0.01 | 14 | 0.165 | None |
| 15 | 1.0 | 75 | 25 | 1.11 | 1.12 | ≦0.01 | 12 | 0.162 | None |
| 16 | 1.0 | 75 | 25 | 1.98 | 1.99 | ≦0.01 | 15 | 0.159 | None |
| Comparative Example | | | | | | | | | |
| 1 | No coating | | | 0.00 | 0.00 | ≦0.01 | 0 | 0.267 | None/Flaw |
| 2 | Scaly zinc phosphate crystals formed. | | | 0.51 | 0.24 | 0.27 | 11 | 0.312 | Light galling |
| 3 | Scaly zinc phosphate crystals formed. | | | 0.98 | 0.56 | 0.42 | 9 | 0.361 | Light galling |
| 4 | Scaly zinc phosphate crystals formed. | | | 1.52 | 0.93 | 0.59 | 12 | 0.366 | Heavy galling |
| 5 | Scaly zinc phosphate crystals formed. | | | 0.58 | 0.21 | 0.37 | 10 | 0.300 | Light galling |
| 6 | Scaly zinc phosphate crystals formed. | | | 1.12 | 0.47 | 0.65 | 8 | 0.323 | Heavy galling |
| 7 | Scaly zinc phosphate crystals formed. | | | 1.57 | 0.62 | 0.95 | 12 | 0.452 | Heavy galling |

*Flaw: Sustained ploughing occurred, caused by small scale seizing on the die surface.
Light galling: Repeated occurrence of ploughing, accompanied by microscopic cracks caused by medium scale seizing, with separation of adhering matter.
Heavy galling: Intermittent occurrence of new moon-shaped to half-moon shaped fractures caused by growth of seized layers and by the resultant macroscopic shear-rupture of the surface layer.

TABLE 3

| Example | Mean particle size (μm) | Cumulative frequency distribution 5% value (μm) | Cumulative frequency distribution 95% value (μm) | Alkaline film removability: Film removal rate (%) | Alkaline film removability: Evaluation | Anti-peeling property: Peeling rate (%) | Anti-peeling property: Evaluation |
|---|---|---|---|---|---|---|---|
| 17 | 0.31 | 0.25 | 0.9 | 90 | ◎ | 2 | ◎ |
| 18 | 0.51 | 0.32 | 1.1 | 91 | ◎ | 3 | ◎ |
| 19 | 0.89 | 0.50 | 2.5 | 93 | ◎ | 4 | ◎ |
| 20 | 1.06 | 0.45 | 3.2 | 94 | ◎ | 6 | ◎ |
| 21 | 1.21 | 0.56 | 4.0 | 97 | ◎ | 8 | ◎ |
| 22 | 1.62 | 0.63 | 4.5 | 98 | ◎ | 12 | ○ |
| 23 | 2.95 | 0.89 | 4.0 | 98 | ◎ | 9 | ◎ |
| 24 | 3.92 | 0.92 | 4.7 | 99 | ◎ | 9 | ◎ |
| 25 | 1.11 | 0.19 | 6.3 | 84 | ○ | 16 | ○ |
| 26 | 0.67 | 0.11 | 4.0 | 81 | ○ | 7 | ◎ |
| 27 | 2.24 | 0.63 | 8.9 | 98 | ◎ | 19 | ○ |
| 28 | 0.29 | 0.22 | 0.9 | 61 | Δ | 4 | ◎ |
| 29 | 4.10 | 1.08 | 4.6 | 98 | ◎ | 32 | Δ |
| 30 | 0.26 | 0.18 | 3.5 | 45 | Δ | 5 | ◎ |
| 31 | 4.35 | 0.58 | 6.5 | 97 | ◎ | 38 | Δ |

TABLE 4

| Example | Crystal configuration at uppermost surface of galvannealed coating layer: Configuration | SEM | $I/I_0$ | Anti-peeling property: Peeling rate (%) | Evaluation |
|---|---|---|---|---|---|
| 32 | Rod-like crystal | (a) | 0.25 | 11 | ○ |
| 33 | Rod-like crystal | — | 0.37 | 9 | ◎ |
| 34 | Rod-like crystal | — | 0.61 | 6 | ◎ |
| 35 | Rod-like crystal | (b) | 0.76 | 5 | ◎ |
| 36 | Rod-like crystal | (c) | 0.83 | 4 | ◎ |
| 37 | Granular crystal | (d) | 0.24 | 21 | Δ |
| 38 | Granular crystal | — | 0.21 | 26 | Δ |

INDUSTRIAL APPLICABILITY

As described above, the present invention realizes at low cost the manufacture of a zinc-based coated steel sheet having a zinc-based coating layer and a lubricative film, formed on the zinc-based coating layer, containing 50 wt. % or more of zinc phosphate particles, and having substantially no reaction layer formed by reaction between the zinc-based coating and the zinc phosphate particles. Since the zinc-based coated steel sheet according to the present invention has an excellent anti-peeling property, excellent frictional property, even under the condition of absence of oil which occurs at areas where the press oil film is broken, and excellent anti-galling property, it is applicable in a wide range of fields, including automotive steel sheets.

The invention claimed is:

1. A zinc-based coated steel sheet comprising a zinc-based coating layer and a film containing zinc phosphate particles in an amount of 50 percent by weight or more, and having substantially no reaction layer formed by reaction between the zinc-based coating and the zinc phosphate particles, wherein the film is formed on the zinc-based coating layer.

2. The zinc-based coated steel sheet of claim 1, wherein the zinc-based coating is a galvannealed coating layer.

3. A zinc-based coated steel sheet comprising a zinc-based coating layer and a film containing zinc phosphate particles in an amount of 50 percent by weight or more, and having substantially no reaction layer formed by reaction between the zinc-based coating and the zinc phosphate particles, wherein the film is formed on the zinc-based coating layer and further contains an organic film-forming supplement.

4. A zinc-based coated steel sheet comprising a zinc-based coating layer and a film containing zinc phosphate particles in an amount of 50 percent by weight or more, and having substantially no reaction layer formed by reaction between the zinc-based coating and the zinc phosphate particles, wherein the film is formed on the zinc-based coating layer and the zinc phosphate particles have mean particle sizes of from 0.3 to 4.0 μm.

5. The zinc-based coated steel sheet of claim 4, wherein the zinc phosphate particles have a cumulative frequency distribution of 5% of zinc phosphate particles having a particle size of 0.2 μm or more and 95% of zinc phosphate particles having a particle size of 5.0 μm or less, counted from the smallest particles, respectively.

6. A zinc-based coated steel sheet comprising a zinc-based coating layer and a film containing zinc phosphate particles in an amount of 50 percent by weight or more, and having substantially no reaction layer formed by reaction between the zinc-based coating and the zinc phosphate particles, wherein the film is formed on the zinc-based coating layer, wherein the zinc-based coating is a galvannealed coating layer and wherein the galvannealed coating layer has a rod-like crystal configuration comprising 50% or more of crystals at the surface thereof.

7. A zinc-based coated steel sheet comprising a zinc-based coating layer and a film containing zinc phosphate particles in an amount of 50 percent by weight or more, and having substantially no reaction layer formed by reaction between the zinc-based coating and the zinc phosphate particles, wherein the film is formed on the zinc-based coating layer, wherein the zinc-based coating is a galvannealed coating layer and wherein the crystal configuration of the surface of the galvannealed coating layer has a diffraction line profile, as determined by X-ray diffractometry, showing a ratio $I/I_0$ of 0.25 or more, I being the peak intensity at a lattic plane spacing d of 1.26 Å, and $I_0$ being the peak intensity at a lattice plane spacing $d_0$ of 1.28 Å.

8. A method of manufacturing a zinc-based coated steel sheet having a film containing zinc phosphate particles in an amount of 50 percent by weight or more, and having substantially no reaction layer formed by reaction between the zinc-based coating and the zinc phosphate particles, comprising the steps of: applying a zinc-based coating to the surface of a steel sheet; applying water containing zinc phosphate particles to the surface of the zinc-based coating layer; and drying the applied water containing zinc phosphate particles.

9. A method of manufacturing a zinc-based coated steel sheet having a film containing zinc phosphate particles in an amount of 50 percent by weight or more, and having substantially no reaction layer formed by reaction between the zinc-based coating and the zinc phosphate particles, comprising the steps of: applying a zinc-based coating to the surface of a steel sheet; applying water containing zinc phosphate particles to the surface of the zinc-based coating layer; and drying the applied water containing zinc phosphate particles, wherein the water containing zinc phosphate particles further contains an organic film-forming supplement.

* * * * *

UNITED STATES PATENT AND TRADEMARK OFFICE

CERTIFICATE OF CORRECTION

PATENT NO. : 7,160,631 B2
APPLICATION NO. : 10/492311
DATED : January 9, 2007
INVENTOR(S) : Seiji Nakajima et al.

It is certified that error appears in the above-identified patent and that said Letters Patent is hereby corrected as shown below:

In Column 8, line 51, please replace “8°C” with --80°C--.

Signed and Sealed this

Thirteenth Day of March, 2007

JON W. DUDAS
*Director of the United States Patent and Trademark Office*